US012533571B2

(12) United States Patent
Corsaut

(10) Patent No.: US 12,533,571 B2
(45) Date of Patent: Jan. 27, 2026

(54) CARD TOSS GAME AND GAMEPLAY METHOD

(71) Applicant: Jordan R. Corsaut, Lenexa, KS (US)

(72) Inventor: Jordan R. Corsaut, Lenexa, KS (US)

( * ) Notice: Subject to any disclaimer, the term of this patent is extended or adjusted under 35 U.S.C. 154(b) by 651 days.

(21) Appl. No.: 17/967,356

(22) Filed: Oct. 17, 2022

(65) Prior Publication Data

US 2023/0122635 A1 Apr. 20, 2023

Related U.S. Application Data

(60) Provisional application No. 63/256,361, filed on Oct. 15, 2021.

(51) Int. Cl.
*A63F 9/02* (2006.01)
*A63F 1/04* (2006.01)

(52) U.S. Cl.
CPC ..... *A63F 9/0278* (2013.01); *A63F 1/04* (2013.01); *A63F 9/0204* (2013.01); *A63F 2009/0282* (2013.01)

(58) Field of Classification Search
CPC ..... A63F 9/0278; A63F 9/0204; A63F 1/04; A63F 2009/0282
See application file for complete search history.

(56) References Cited

U.S. PATENT DOCUMENTS 2,326,859 A * 8/1943 Hoover ..... A63F 7/305 273/123 R
3,458,196 A * 7/1969 Monzulla ..... A63F 9/0204 273/396
4,066,262 A * 1/1978 Stiefel ..... A63B 63/08 273/400
4,900,035 A * 2/1990 Carmo ..... A63F 9/02 273/DIG. 26
4,938,485 A * 7/1990 Hockridge ..... A63F 9/02 273/DIG. 30
9,782,666 B2 * 10/2017 Dahl ..... A63B 69/40
12,296,242 B1 * 5/2025 Shields ..... A63B 69/3676
2006/0125186 A1 * 6/2006 Digges, III ..... A63B 67/06 273/402
2007/0001399 A1 * 1/2007 Staver ..... A63B 67/06 273/317.5
2008/0042360 A1 * 2/2008 Veikley ..... A63B 67/06 273/398
2012/0225742 A1 * 9/2012 Max ..... A63B 63/08 473/481
2012/0235356 A1 * 9/2012 Weiss ..... A63F 1/04 273/398
2014/0265138 A1 * 9/2014 Esposito ..... A63B 67/06 273/400

(Continued)

*Primary Examiner* — Steve Rowland
(74) *Attorney, Agent, or Firm* — AVEK IP, LLC

(57) ABSTRACT

A throwing game including an elongated board with targets at both ends. The targets can be formed from cylinders and/or funnels. Points are scored based on the target sizes, with more points being awarded for tossing cards into the smaller or more difficult targets. The board can be collapsible and stored in a bag or box for portability. All of the targets, deck of cards, and other accessories can be stored within the same bag or box. Stands may be used to hold the board away from the ground. In one embodiment, modifiers on the cards can change the value of a scored point.

14 Claims, 10 Drawing Sheets

(56) References Cited

U.S. PATENT DOCUMENTS

| | | | | |
|---|---|---|---|---|
| 2015/0137452 | A1* | 5/2015 | Dahl | A63F 7/249<br>273/342 |
| 2019/0060729 | A1* | 2/2019 | Saleeby | A63B 57/40 |
| 2019/0381393 | A1* | 12/2019 | Hanson | A63B 67/066 |
| 2020/0047060 | A1* | 2/2020 | Bauer | A63F 7/0668 |
| 2022/0118329 | A1* | 4/2022 | Anderson | A63B 67/06 |
| 2024/0197239 | A1* | 6/2024 | Bontrager | A61B 5/4088 |

* cited by examiner

CARD TOSS GAME AND GAMEPLAY METHOD

CROSS-REFERENCE TO RELATED APPLICATION

This application claims priority in U.S. Provisional Patent Application No. 63/256,361 Filed Oct. 15, 2021, which is incorporated herein by reference.

BACKGROUND OF THE INVENTION

1. Field of the Invention

The present invention relates generally to games, and in particular to an original, unique card toss game with a novel board, cards, targets and gameplay method.

2. Description of the Related Art

Various games have been utilized for competitive play. For example, players can compete for points, merchandise, money and other prizes. Many competitive games involve elements of player skill and chance as factors in determining outcomes. Games of skill, such as the present card toss game invention, are useful for improving players' hand-eye coordination and skill. Moreover, the competitive nature of the present invention provides entertainment and amusement in a competitive environment.

Heretofore there has not been available a game and gameplay method with the advantages and features of the present invention.

BRIEF SUMMARY OF THE INVENTION

The game apparatus of the present invention generally comprises an elongated board with targets at both ends. The targets can comprise cylinders and/or funnels. Points are scored based on the target sizes, with more points being awarded for tossing objects, such as cards, into the smaller targets.

The board can be collapsible and stored in a bag or box for portability. All of the targets, deck of cards, and other accessories can be stored within the same bag or box.

Stands may be used to hold the board away from the ground.

In one embodiment, modifiers on the cards can change the value of a scored point.

The tossable object in a preferred embodiment are playing cards, but any tossable object could be used to score goals including bags, coins, balls, darts, or any suitable tossable object.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Card Toss Game 2

Figure 1:
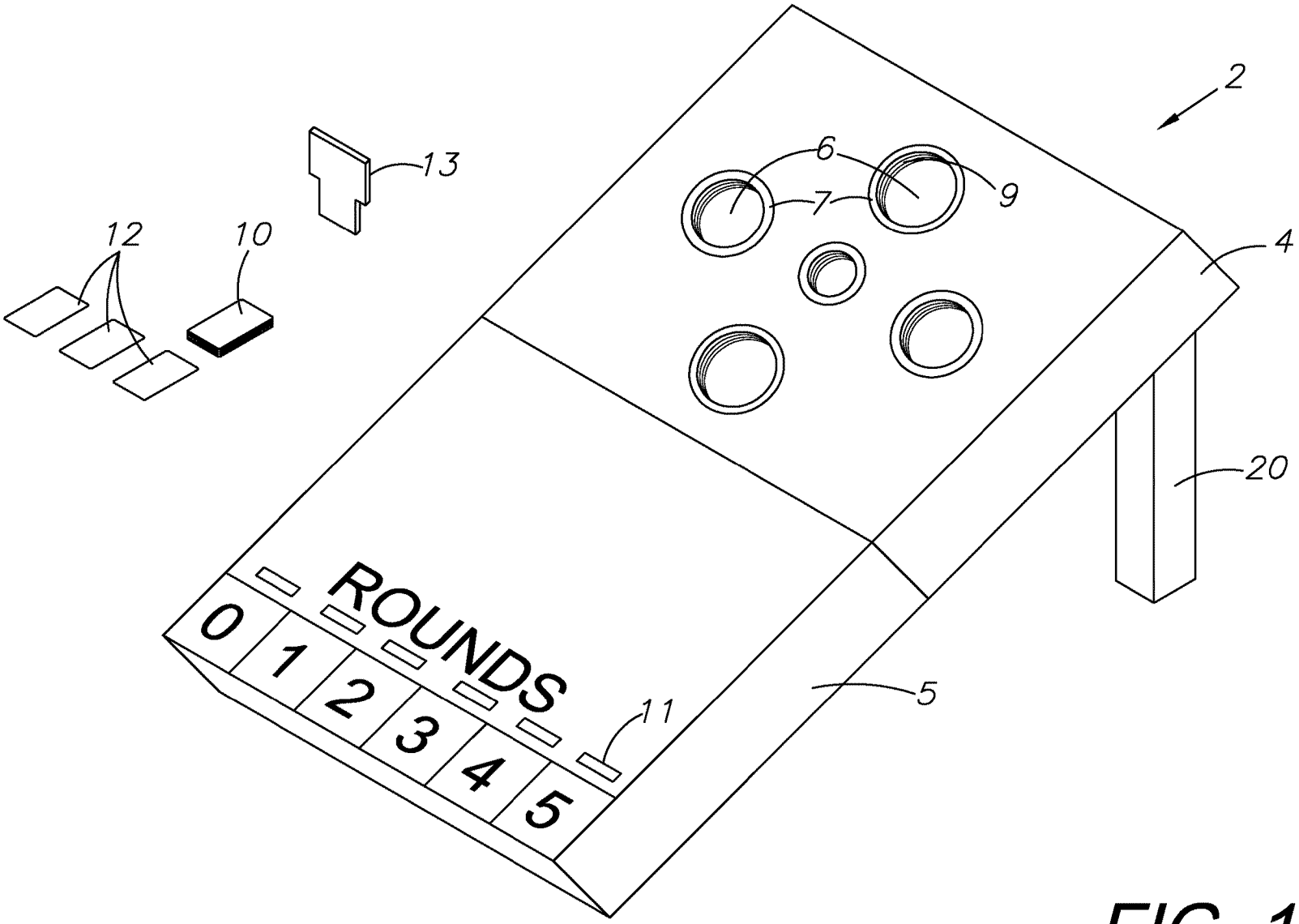
FIG. 1 is a three-dimensional isometric view of a preferred embodiment of the present invention.
Figure 2:
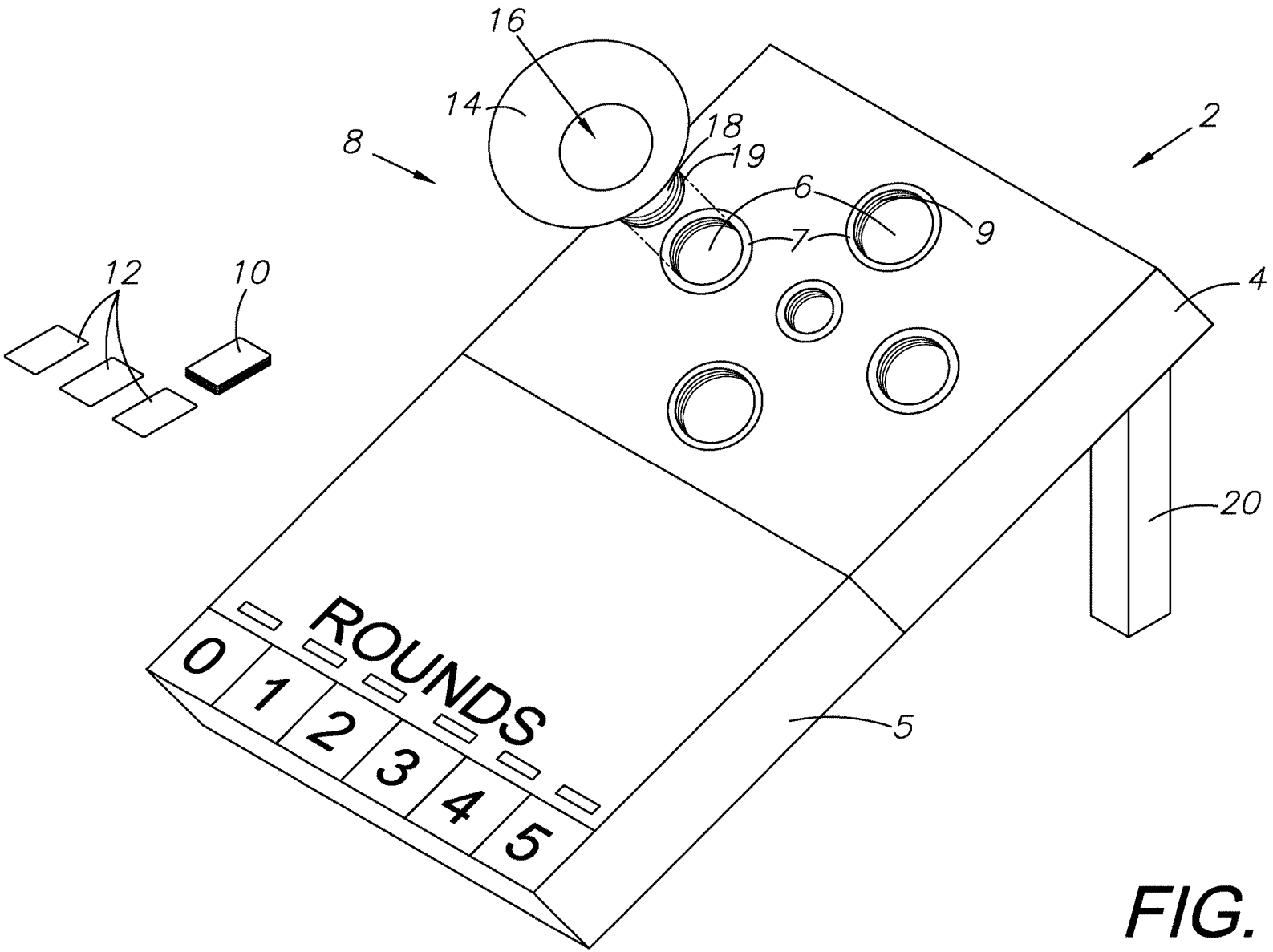
FIG. 2 is another three-dimensional view thereof, showing the installation of goal elements.
Figure 3:
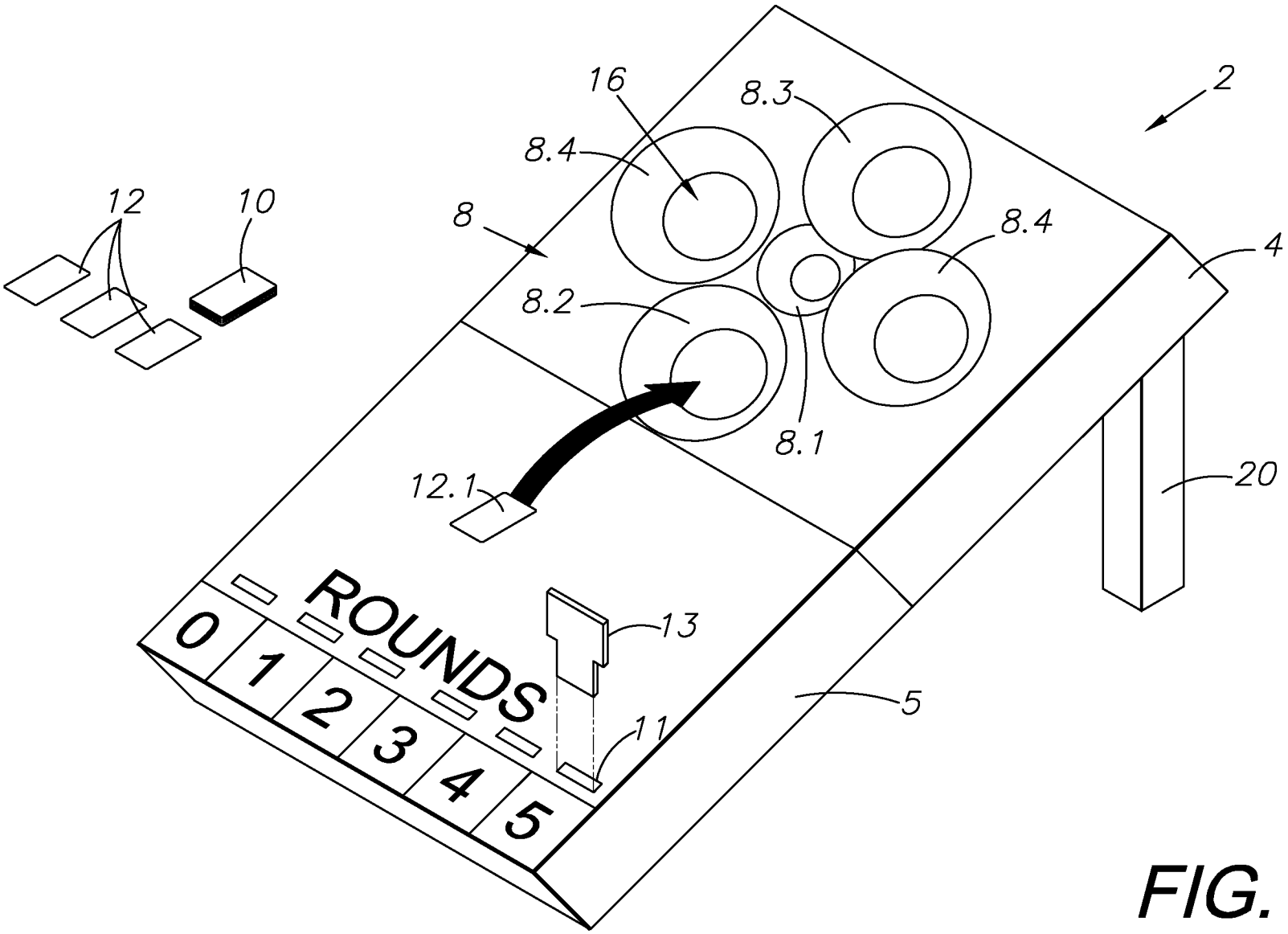
FIG. 3 is another three-dimensional view thereof, wherein the goal elements are installed and a game is being played.
Figure 4:
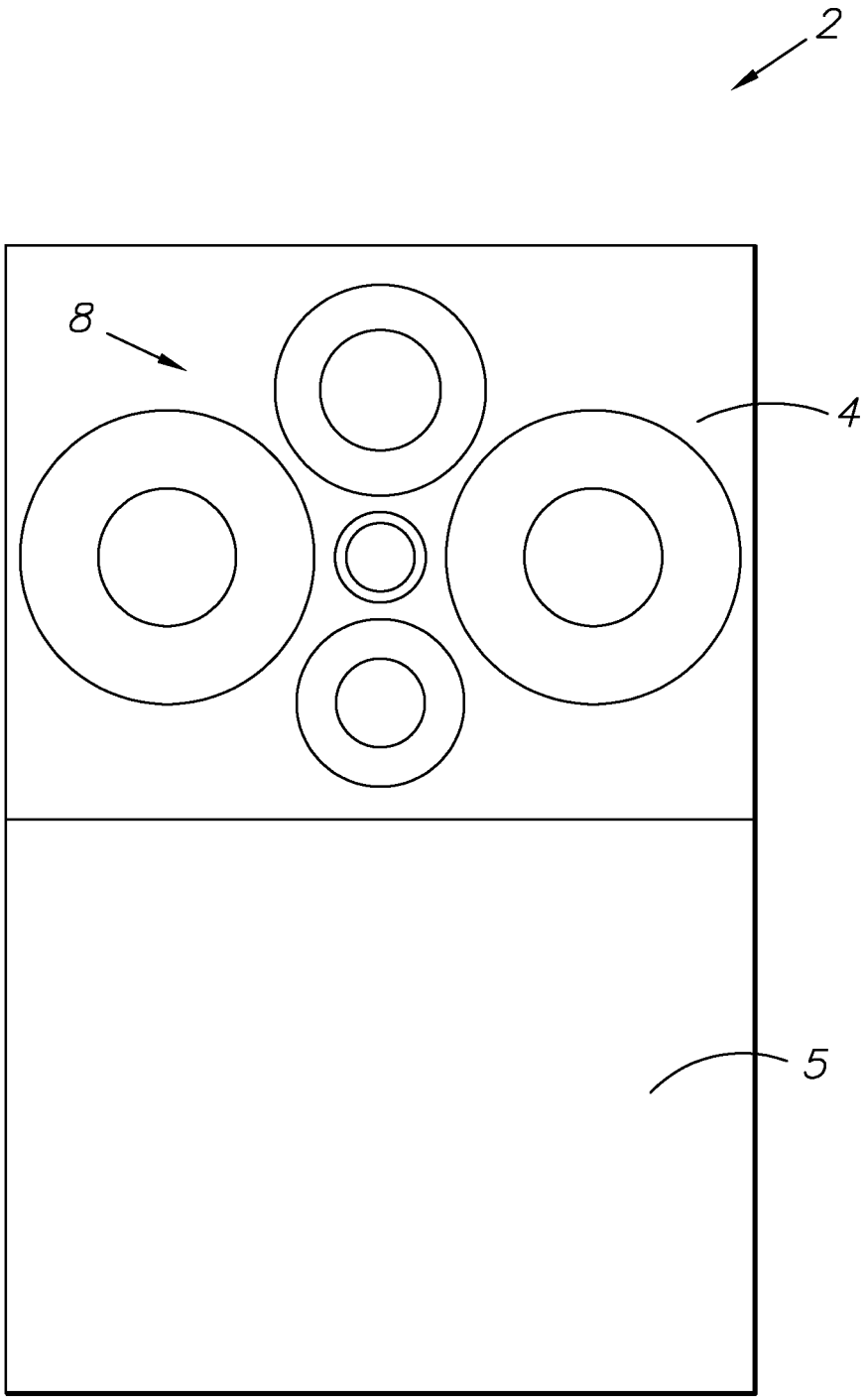
FIG. 4 is a top plan view thereof.

As shown in FIGS. 1-5, the present invention is a card toss game 2 having a game board with a top half 4 and a bottom half 5, and several goals 8 which can be threaded into receiver cups 6 within the game board's upper half 4. The receiver cups 6 have locking channels 9 which receive the locking channels 19 of the base 18 of a respective goal 8. As shown in FIG. 3, multiple different goals 8.1, 8.2, 8.3, and 8.4 of various sizes and shapes can be used. Each goal 8 may include a cone-shaped receiver 14 which funnels thrown cards 12 down into the center 16 and into a respective receiver cup 6. A deck 10 of throwing cards 12 are tossed towards the goals 8, with the purpose of getting each card 12 within the opening 16 of the goals 8. It should be noted that any tossable object could be used to score a goal with this game system, including, but not limited to, cards, balls, bags, rings, coins, and darts.

At the bottom edge of the lower half 5 of the game board, round winners can be indicated by placing score cards 13 into score card slots 11. These score cards could be of various colors or contain a number or letter corresponding to the player who won that round.

Figure 7:
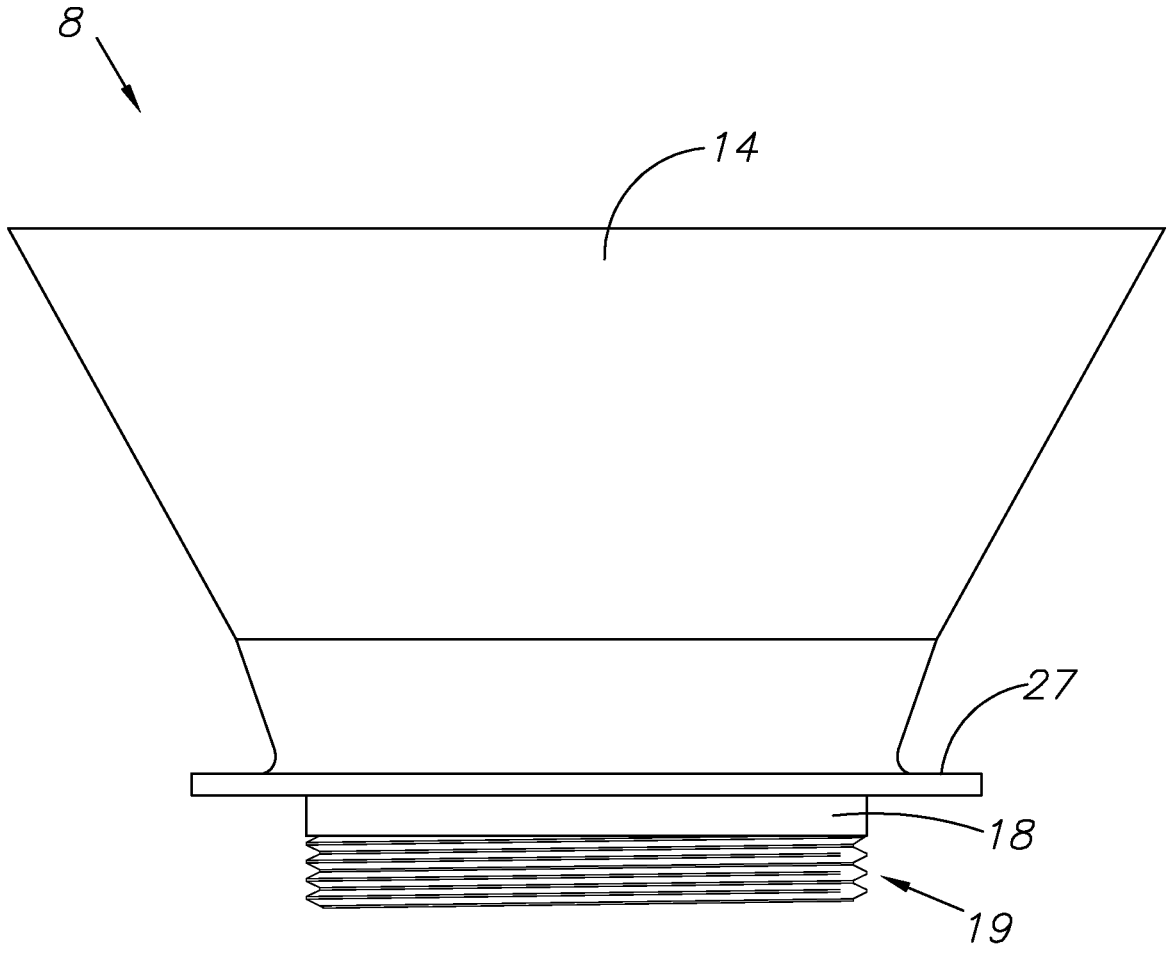
FIG. 7 is a front elevational view of a goal element thereof.

Each of the receiver cups 6 has a lip 7 which may indicate the score value for that goal. As shown in FIG. 7, each of the goals 8 may also have a lip 27 which may correspond to the lip 7 of the respective cup 6. These lips 7, 27 could show the point value for that particular goal 8 or other information.

Figure 5:
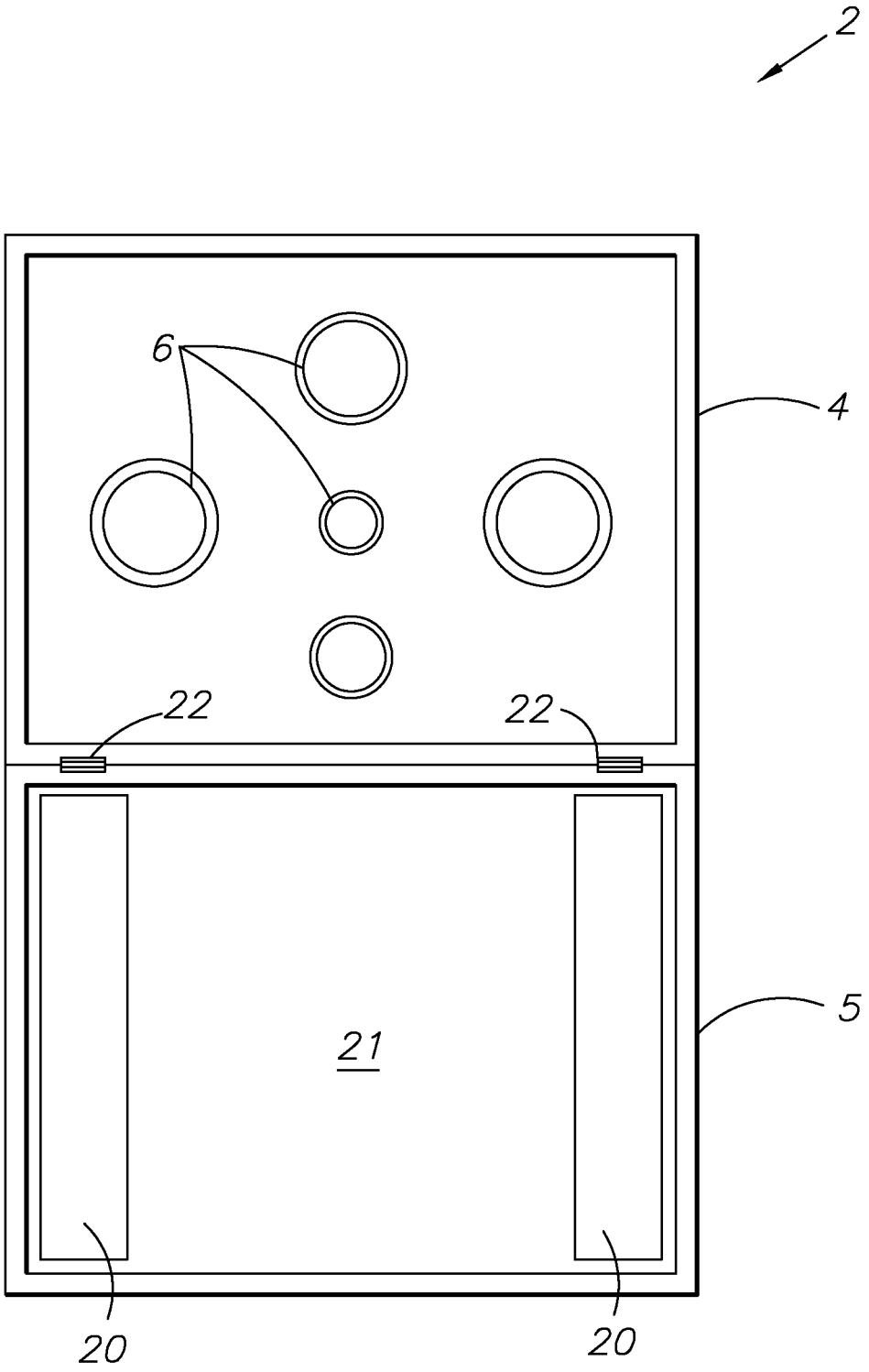
FIG. 5 is a rear plan view thereof.

The game 2 may have a pair of legs 20 which are either selectively removable from the top half 4 of the game board or which can hinge up and into the game board when not in use. As shown in FIG. 5, a storage space 21 within the back face of the bottom half 5 of the game board can be used to store legs 20, goals 8, the deck 10 of cards 12 and the score cards 13. FIG. 5 also shows a pair of hinges 22 which can be used to close the entire game board such that the top half 4 and the bottom half 5 close with all of the accessories including the goals 8, cards 12, and legs 20 within the game board for transportation and storage. A handle could be included as well as latches for locking the game board closed.

Figure 8:
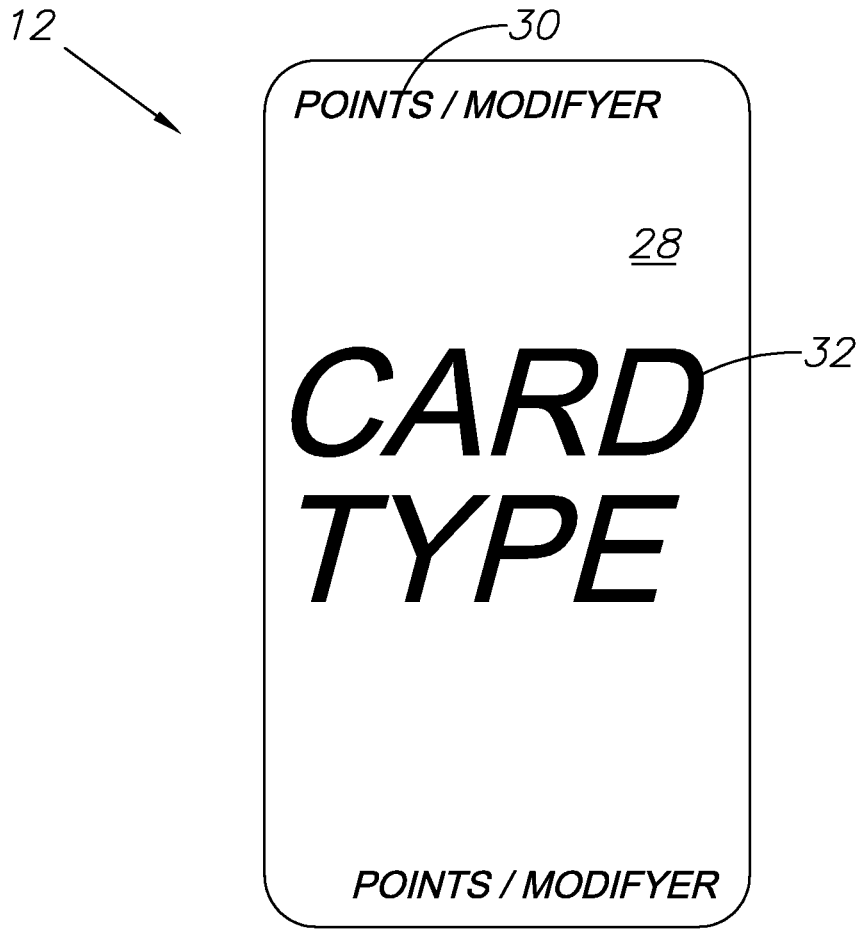
FIG. 8 is a front elevational view of a card element thereof.

FIG. 8 shows one playing card 12 which can be thrown or tossed towards the goals 8 on one side of the board 4 as shown in FIG. 3. Each side can have the same orientation of goals 8, or the goals could be distinct depending on each player's choices. Goals may be swapped out as desired in some forms of play, or may remain static for the entirety of the gameplay session. More advanced users may wish to challenge themselves with more difficult goals, and therefore higher score possibilities.

The cards 12 as shown in FIG. 8 include a front face 28 and a rear face (not shown). Each of the front and rear faces may contain card information, such as a card type 32 and a points modifier 30 or value. In one aspect of the game, the points modifier 30 could increase the points scored within a goal by a set value or multiplier (e.g. 3*x* multiplier). Alternatively, the cards themselves could have points values which are separate to or additive with the goals 8 themselves.

Figure 9A:
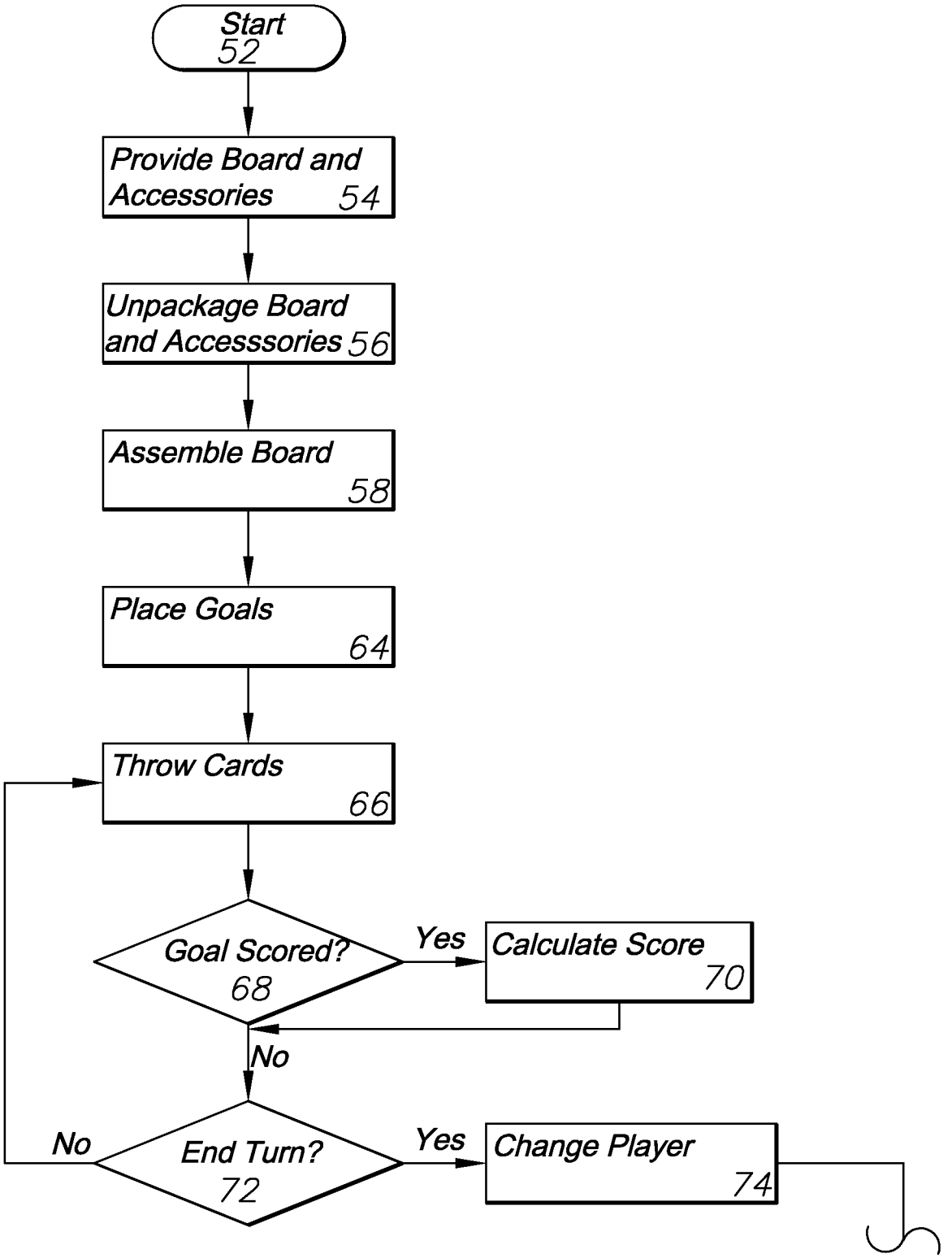
FIG. 9A is a flowchart diagramming steps taken to practice an embodiment of the present invention, the flowchart continuing onto FIG. 9B.
Figure 9B:
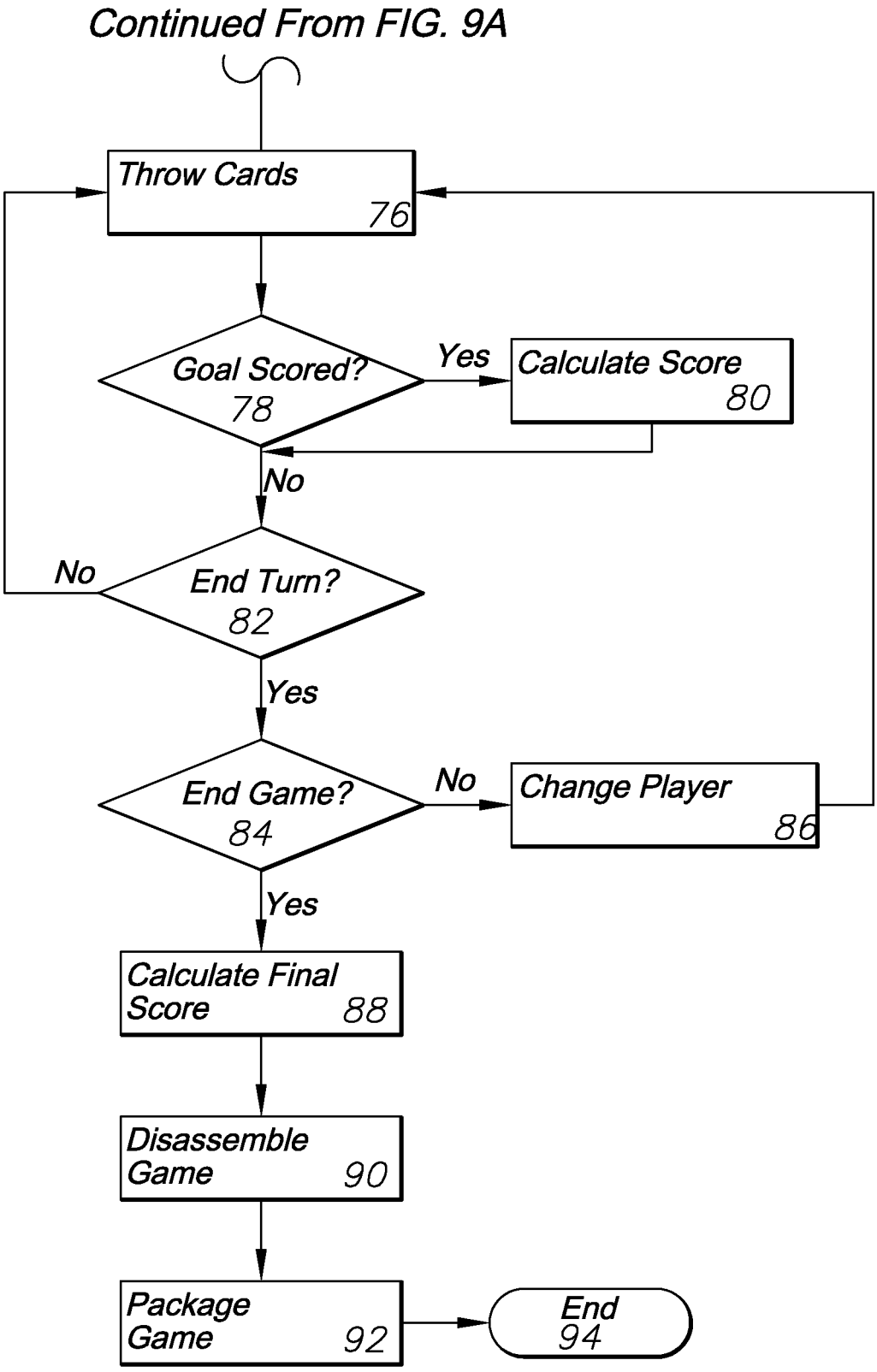
FIG. 9B is a flowchart thereof continuing from FIG. 9A.

FIGS. 9A and 9B show steps taken in practicing an embodiment of the present invention. The method starts at 52 where a board and accessories are provided at 54. These could be provided in a box or bag as described above, or any other suitable way of presenting the game to users.

The board and accessories are unpackaged at 56 and assembled at 58. This includes unclasping and opening the board so that the top half 4 and bottom half 5 form a playing surface. The goals 8 can be threaded into the cups 6, and the legs 20 are installed or simply hinged downwards to support the game board.

If a goal is scored at 68, the score is calculated at 70. This score may be as simple as a single point value based upon the goal or the card, or may be calculated based upon a score modifier 30 shown on the card 12 which is used to multiply or otherwise adjust the score value of the goal 8 in which the card 12 was scored.

If no goals are scored or the user throws all of their cards and their score is calculated, their turn will eventually end at 72. Two players could simultaneously play, but a preferred embodiment has players alternating turns throwing one or more cards. Once the turn ends at 72, the other player has a chance to play at 74.

Figure 6:
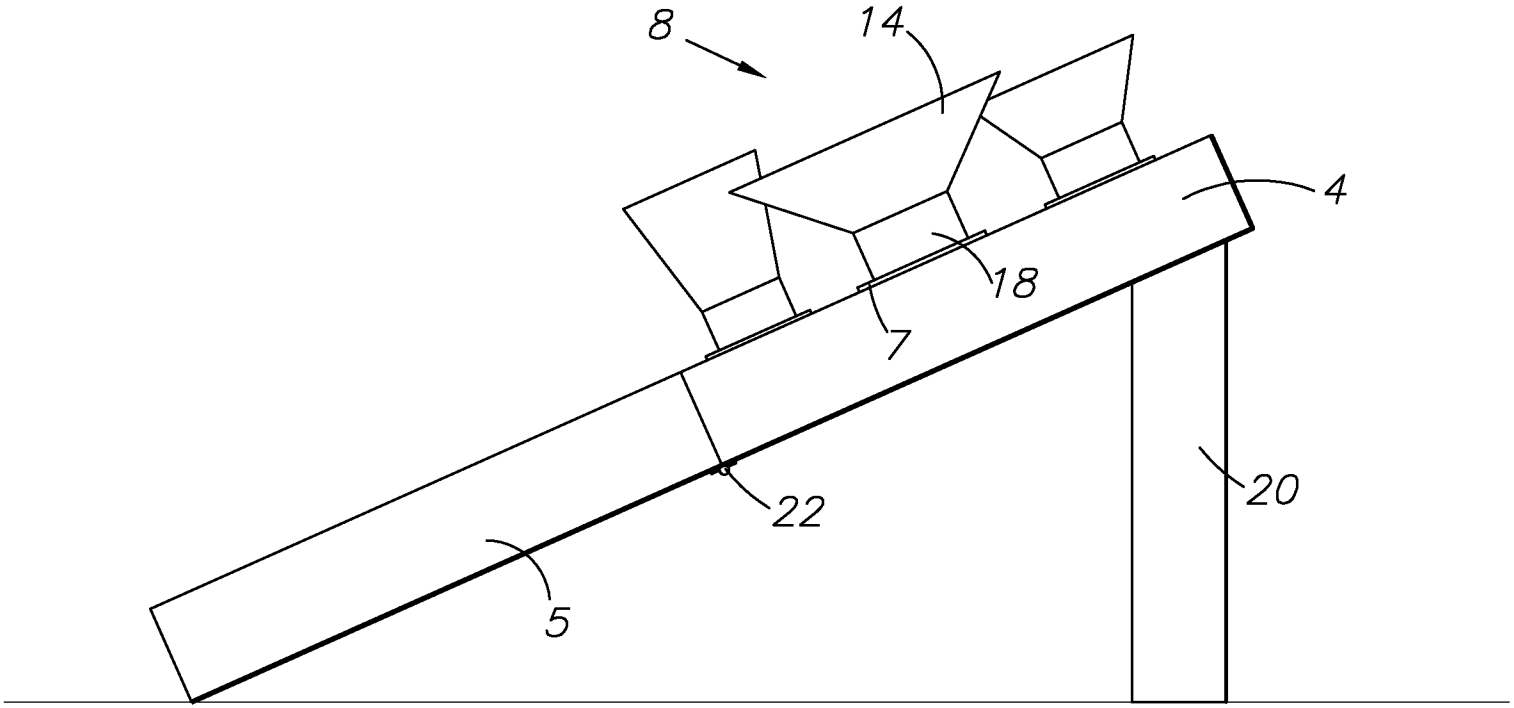
FIG. 6 is a side elevational view thereof.

As continued on FIG. 6B, the second player throws cards at 76 towards the goals. As before, if a goal is scored at 78, the score is calculated at 80. If the goal 8 in which the card 12 was scored. This continues until the player's turn ends at 82. Once both players have had a turn, the game may end at 84, or may continue to go back and forth by changing players at 86. Otherwise, a final score is calculated at 88 and a winner is determined. The game may be disassembled at 90 and packaged away at 92, ending the process at 94.

The card toss game apparatus can be constructed of various materials. For example, and without limitation on the generality of useful materials, the board can comprise Coroplast® corrugated plastic, which is available from Coroplast, LLC, a member of the Inteplast Group of companies. Other materials for the board include cardboard, plastic panels and plywood. The board can be configured for folding or rolling to conserve space for storage and convenience.

The targets can be vacuum-formed or blow-molded plastic, sheet-metal or fabricated from other materials. The targets can be color-coded, e.g., a first color for targets placed at one end of the board and a second color for targets placed at the other end of the board. The color coding can correspond to corporate color identities, school colors, or other design choices.

The invention can be made via 3D printing, or via any other means fabrication and manufacturing processes.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A game system comprising:

a game board;

a first goal inserted into a first receiver cup within said game board;

a second goal inserted into a second receiver cup within said game board;

said first goal having a first value and said second goal having a second value;

each of said first and second receiver cups comprising receiver locking channels;

each of said first and second goals comprising goal locking channels;

wherein said first and second goals are threadedly received by respective said first and second receiver cups via said receiver locking channels and said goal locking channels; and a tossable object configured to be tossed towards said first goal and said second goal, wherein points are scored when said tossable object is received within one of said first goal and said second goal.

2. The system of claim 1, wherein said tossable object comprises a card from a deck of throwable cards.

3. The system of claim 2, further comprising:

each card of said deck of throwable cards comprising a score modifier configured to adjust said first value and said second value of said first goal and said second goal.

4. The system of claim 1, further comprising:

said game board comprising an upper half and a lower half joined via at least one hinge;

said upper half and said lower half of said game board defining an interior space;

wherein said game board can be transformed from a first, closed orientation and a second, open orientation by moving said upper half and said lower half about said at least one hinge; and wherein said game board is configured to store said first goal, said second goal, and said tossable object within said interior space when in said first, closed orientation.

5. The system of claim 1, further comprising:

said first goal having a flared top end with a central opening;

said first goal further comprising a cylindrical base configured to secure said first goal within said first goal receiver; and wherein said first value is determined based upon said flared top end.

6. The system of claim 4, wherein said top end comprises a cone.

7. The system of claim 1, further comprising a leg disposed within said game board.

8. The system of claim 7, wherein said leg is attached to said game board via a hinge.

9. The system of claim 1, further comprising:

a plurality of score card slots located within said game board; and at least one score card configured to be inserted within one of said score card slots.

10. A method of playing a game, the method comprising the steps:

setting up a game board having a first receiver cup and a second receiver cup;

inserting a first goal into said first receiver cup, said first goal having a first value;

inserting a second goal into said second receiver cup, said second goal having a second value;

wherein each of said first and second receiver cups comprising receiver locking channels;

wherein each of said first and second goals comprising goal locking channels;

threadably receiving said first and second goals by respective said first and second receiver cups via said receiver locking channels and said goal locking channels;

providing a tossable object;

wherein each of said first goal and said second goal comprise a respective top opening for receiving said tossable object;

throwing said tossable object at said first goal and said second goal one card at a time; and calculating a score based upon said tossable object received within the respective said top openings of said first goal and said second goal, said first value, and said second value.

11. The method of claim 10, further comprising the steps:

opening said gameboard from a first, closed orientation to a second, deployed orientation, wherein said gameboard comprises an upper half and a lower half joined by at least one hinge, said upper half and lower half defining an interior space in said first, closed orientation; and removing from said interior space said first goal and said second goal.

12. The method of claim 11, further comprising the step:

positioning at least one leg beneath said gameboard.

13. The method of claim 12, wherein said leg is attached to said gameboard via a hinge.

14. The method of claim 10, further comprising the step:

inserting a score card into a score card slot located within said gameboard.

* * * * *